US011987918B2

(12) United States Patent
Nishizaki et al.

(10) Patent No.: US 11,987,918 B2
(45) Date of Patent: May 21, 2024

(54) CUTTING SYSTEM AND CUTTING DEVICE

(71) Applicant: BROTHER KOGYO KABUSHIKI KAISHA, Nagoya (JP)

(72) Inventors: Mayumi Nishizaki, Nagoya (JP); Kanae Minamikawa, Nagoya (JP); Yoko Yamanashi, Konan (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 120 days.

(21) Appl. No.: 17/702,980

(22) Filed: Mar. 24, 2022

(65) Prior Publication Data

US 2022/0316117 A1 Oct. 6, 2022

(30) Foreign Application Priority Data

Mar. 31, 2021 (JP) ..... 2021-059064

(51) Int. Cl.
*D05B 37/04* (2006.01)
*D05B 19/10* (2006.01)
*D05C 7/00* (2006.01)

(52) U.S. Cl.
CPC ..... *D05B 37/04* (2013.01); *D05B 19/10* (2013.01); *D05C 7/00* (2013.01)

(58) Field of Classification Search
CPC ..... D05B 19/08; D05B 19/10; D05B 37/04; D05C 5/02; D05C 7/00
See application file for complete search history.

(56) References Cited

U.S. PATENT DOCUMENTS 5,438,520 A * 8/1995 Satoh ..... D05B 19/08 112/102.5
5,740,055 A * 4/1998 Iwata ..... D05B 19/08 112/80.23
2004/0083022 A1 4/2004 Akira et al.
2014/0283662 A1 9/2014 Masashi et al.
2016/0031108 A1* 2/2016 Bailie ..... B26D 5/005 700/134
2020/0107598 A1* 4/2020 Ramos ..... B41M 5/0256

* cited by examiner

*Primary Examiner* — Nathan E Durham
(74) *Attorney, Agent, or Firm* — K&L Gates LLP

(57) ABSTRACT

A cutting system includes a sewing machine and a cutting device. The sewing machine includes a sewing portion, a sewing communication portion, a sewing processor, and a sewing memory. The sewing machine acquires an embroidery data stored in the sewing memory. The sewing machine sends, via a network line, the acquired embroidery data. The cutting device includes a cutting portion, a cutter communication portion, a cutter processor, and a cutter memory. The cutting device receives, via the network line, the embroidery data sent by the sewing machine. The cutting device generates a cutting data based on the received embroidery data. The cutting device drives the cutting portion based on the generated cutting data, and cuts the object to be cut.

8 Claims, 13 Drawing Sheets

FIG. 4

EMBROIDERY DATA D1

| | | |
|---|---|---|
| SEWING ORDER:1 | SEWING ORDER:2 | SEWING ORDER:3 |
| THREAD COLOR:BROWN | THREAD COLOR:RED | THREAD COLOR:GREEN |
| COORDINATE DATA (PARTIAL PATTERNS 51) | COORDINATE DATA (PARTIAL PATTERNS 52) | COORDINATE DATA (PARTIAL PATTERNS 53) |

FIG. 6

EMBROIDERY DATA D2

| | | | |
|---|---|---|---|
| SEWING ORDER:1 | SEWING ORDER:2 | SEWING ORDER:3 | - |
| THREAD COLOR:BROWN | THREAD COLOR:RED | THREAD COLOR:GREEN | - |
| COORDINATE DATA (PARTIAL PATTERNS 51) | COORDINATE DATA (PARTIAL PATTERNS 52) | COORDINATE DATA (PARTIAL PATTERNS 53) | PROCESSING DATA (OUTLINES La, Lb) |

CUTTING SYSTEM AND CUTTING DEVICE

CROSS REFERENCE TO RELATED APPLICATIONS

This application claims priority to Japanese Patent Application No. 2021-059064, filed Mar. 31, 2021. The disclosure of the foregoing application is incorporated herein by reference in its entirety.

BACKGROUND

The present disclosure relates to a cutting system and a cutting device.

A cutting device cuts a target object by causing a cutter held in a cartridge holder and the sheet-shaped target object to move relative to each other. The cutting device creates cutting data based on image data, by executing a cutting data creation program. The cutting device performs a cutting operation to cut the target object, by driving each of motors on the basis of the created cutting data.

SUMMARY

In order to efficiently perform the cutting operation using the cutting device, cooperation between the cutting device and another device is desirable. A specific example of a cooperation method is as follows. The cutting device acquires embroidery data from a sewing machine or an embroidery data creation device. The cutting device cuts the target object along an outer shape of an embroidery pattern to be embroidered by the sewing machine, on the basis of the acquired embroidery data. However, with a known cutting device, it is not possible to perform the cutting operation in cooperation with the sewing machine or the embroidery data creation device.

The object of the present disclosure is to provide a cutting system and a cutting device by which the cutting device is capable of performing a cutting operation in cooperation with a sewing machine or an embroidery data creation device.

Various embodiments herein provide a cutting system including a sewing machine and a cutting device. The sewing machine includes a sewing portion, a sewing communication portion, a sewing processor, and a sewing memory. The sewing portion is configured to sew an embroidery pattern on an object to be sewn, based on embroidery data for sewing the embroidery pattern. The sewing communication portion is configured to perform communication via a network line. The sewing memory is configured to store the embroidery data, and to store computer-readable instructions that, when executed by the sewing processor, instruct the sewing processor to perform processes. The processes include an acquisition process and a sewing send process. The acquisition process acquires the embroidery data stored in the sewing memory. The sewing send process sends, via the network line, using the sewing communication portion, the embroidery data acquired by the acquisition process. The cutting device includes a cutting portion, a cutter communication portion, a cutter processor, and a cutter memory. The cutting portion is configured to cut an object to be cut, based on cutting data. The cutter communication portion is configured to perform communication via the network line. The cutter memory is configured to store computer-readable instructions, that when executed by the cutter processor, instruct the cutter processor to perform processes. The processes include a cutter reception process, a generation process, and a cutting process. The cutter reception process receives, via the network line, using the cutter communication portion, the embroidery data sent by the sewing machine. The generation process generates the cutting data, based on the embroidery data received by the cutter reception process. The cutting process drives the cutting portion based on the cutting data generated by the generation process, and cut the object to be cut.

Various embodiments also provide a cutting device that includes a cutting portion, a cutter communication portion, a cutter processor, and a cutter memory. The cutting portion is configured to cut an object to be cut, based on cutting data. The cutter communication portion is configured to perform wireless communication. The cutter memory is configured to store computer-readable instructions that, when executed by the cutter processor, cause the cutter processor to perform processes. The processes include a cutter reception process, a generation process, and a cutting process. The cutter reception process receives, using the cutter communication portion and by wireless communication, embroidery data which is for sewing an embroidery pattern and which is sent by an embroidery data creation device. The generation process generates the cutting data, based on the embroidery data received by the cutter reception process. The cutting process to drive the cutting portion based on the cutting data generated by the generation process, and cut the object to be cut.

The cutting device receives, via the network line, the embroidery data sent by the sewing machine, and generates the cutting data based on the received embroidery data. The cutting device acquires the embroidery data from the sewing machine by cooperating with the sewing machine, and can generate the cutting data necessary at a time of cutting.

BRIEF DESCRIPTION OF THE DRAWINGS

Embodiments of the disclosure will be described below in detail with reference to the accompanying drawings in which:

FIG. 4 is a view of embroidery data;

FIG. 6 is a view of embroidery data;

DETAILED DESCRIPTION

A system 1 according to the present disclosure will be described with reference to the drawings. The drawings that are referenced are used to illustrate the technical characteristics that can be employed by the present disclosure. The configurations and the like of the devices that are described are not intended to be limited thereto, but are merely illustrative examples.

Outline of the System 1

Figure 1:
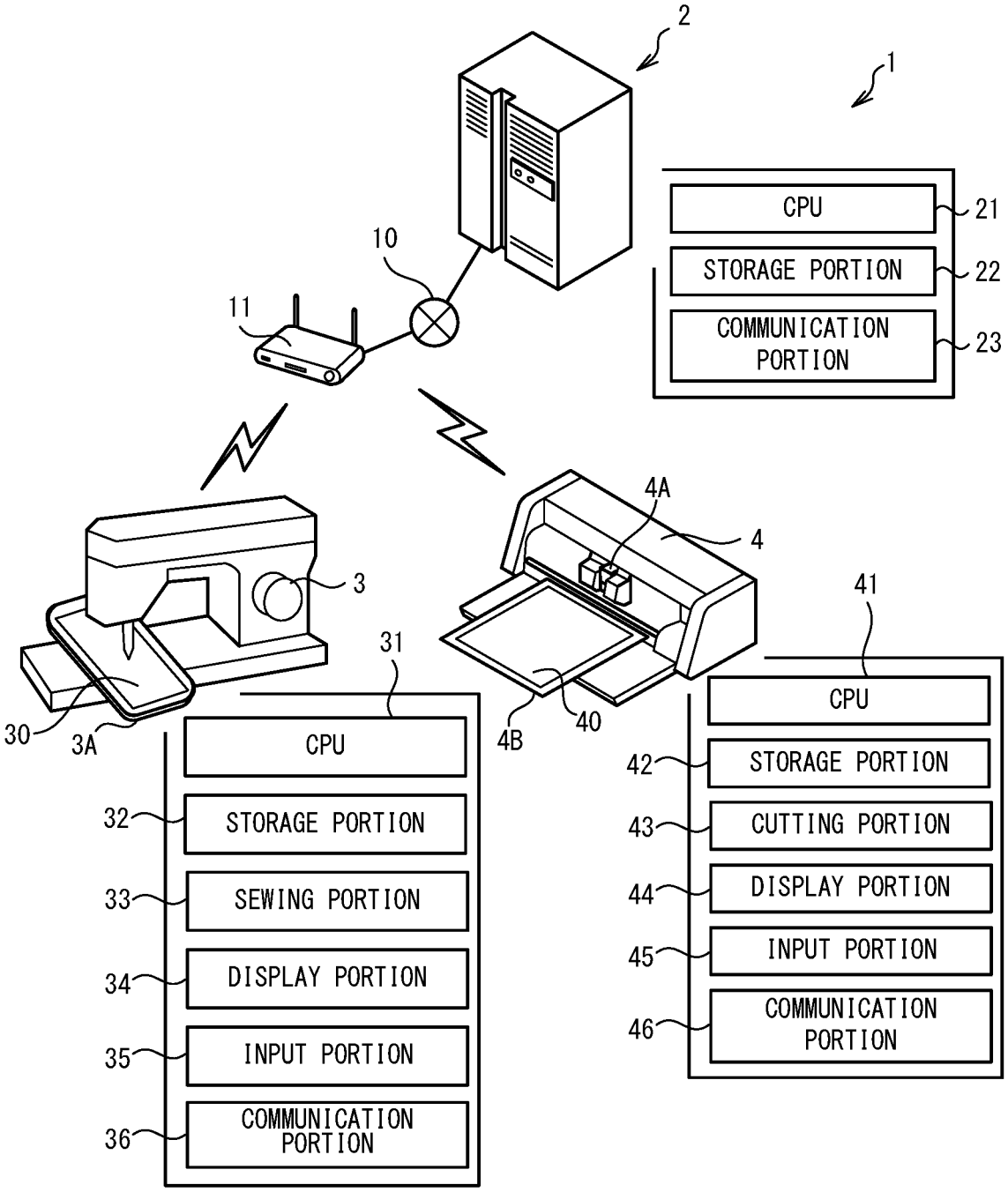
FIG. 1 is a view of an outline of a system.

An outline of the system 1 will be described with reference to FIG. 1. The system 1 has a server device 2, a sewing machine 3, and a cutting device 4. The server device 2 communicably connects to an access point 11 via a network line 10. The sewing machine 3 and the cutting device 4 both communicably connect wirelessly to the access point 11. Therefore, the server device 2, the sewing machine 3, and the cutting device 4 are able to communicate with each another via the network line 10 and the access point 11.

The server device 2 has a CPU 21, a storage portion 22, and a communication portion 23. The CPU 21 is responsible for overall control of the server device 2. A server program to be executed by the CPU 21, and embroidery data and cutting data and the like, which will be described later, are stored in the storage portion 22. The communication portion 23 is a communication module for performing communication with the sewing machine 3 and the cutting device 4 via the network line 10 and the access point 11.

The sewing machine 3 has a function of sewing an embroidery pattern onto an object 30 to be sewn. The sewing machine 3 has a CPU 31, a storage portion 32, a sewing portion 33, a display portion 34, an input portion 35, and a communication portion 36. A sewing program to be executed by the CPU 31, and embroidery data for sewing the embroidery pattern, and the like are stored in the storage portion 32. The sewing portion 33 has an upper shaft drive portion and an embroidery frame movement portion. The upper shaft drive portion reciprocally drives a sewing needle connected to a needle bar, not shown in the drawings, up and down. The embroidery pattern movement portion moves an embroidery frame 3A that holds the object 30 to be sewn. The CPU 31 controls the sewing portion 33 on the basis of the sewing data stored in the storage portion 32 and simultaneously drives the upper shaft drive portion and the embroidery frame movement portion so as to sew the embroidery pattern on the object 30 to be sewn that is held by the embroidery frame 3A.

The display portion 34 is a liquid crystal display. The input portion 35 is a touch panel provided on the surface of the display portion 34. The communication portion 36 is a communication module for communicating with the server device 2 via the network line 10 and the access point 11.

The cutting device 4 cuts an object 40 to be cut, using a cutting blade of a cartridge 4A. The cutting device 4 has a CPU 41, a storage portion 42, a cutting portion 43, a display portion 44, an input portion 45, and a communication portion 46. The CPU 41 is responsible for the overall control of the cutting device 4. A cutting program to be executed by the CPU 41, embroidery data, and cutting data for cutting the object 40 to be cut, and the like are stored in the storage portion 42. The cutting portion 43 has a conveyance mechanism, a first movement mechanism, and a second movement mechanism. The conveyance mechanism conveys, in a sub-scanning direction, a holding frame 4B that holds the object 40 to be cut on an upper surface thereof. The first movement mechanism moves the cartridge 4A in a main scanning direction. The second movement mechanism moves the cartridge 4A in an up-down direction orthogonal to the main scanning direction and the sub-scanning direction. The CPU 41 controls the cutting portion 43 in the following manner on the basis of the cutting data stored in the storage portion 42. The CPU 41 controls the second movement mechanism to move the cartridge 4A downward such that the cutting blade and the object 40 to be cut come into contact with one another. In this state, the CPU 41 controls the conveyance mechanism and the first movement mechanism to move the holding frame 4B and the cartridge 4A. As a result, the cutting blade moves relative to the object 40 to be cut in the main scanning direction and the sub-scanning direction, and cuts the object 40 to be cut.

The display portion 44 is a liquid crystal display. The input portion 45 is a touch panel provided on the surface of the display portion 44. The communication portion 46 is a communication module for communicating with the server device 2 via the network line 10 and the access point 11.

Embroidery Pattern 5 and Embroidery Data D1

Figure 2A:
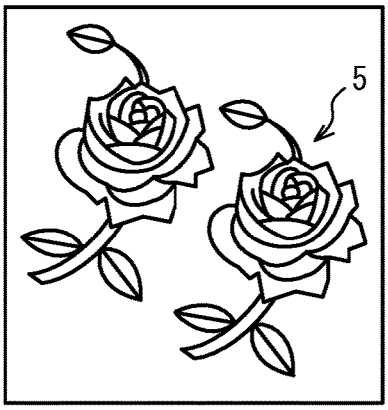
FIG. 2A to FIG. 2D are views of an embroidery pattern and a plurality of partial patterns.
Figure 2B:
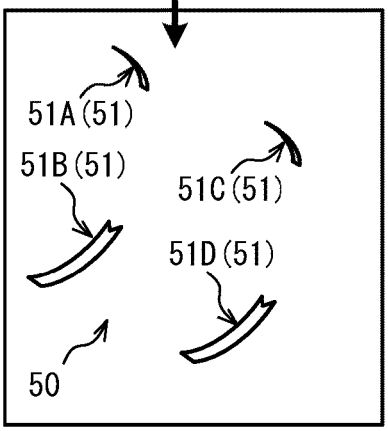
Figure 2C:
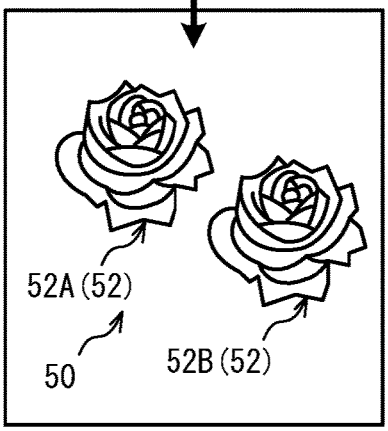
Figure 2D:
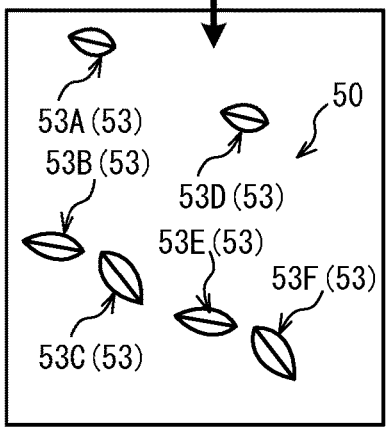

The embroidery pattern to be sewn on the basis of the embroidery data will be described using a specific example. As illustrated in FIG. 2A, an embroidery pattern 5 is formed by partial patterns 51A to 51D (refer to FIG. 2B), 52A, 52B (refer to FIG. 2C), and 53A to 53F (refer to FIG. 2D) divided by the color of the sewing thread (hereinafter, referred to as "thread color") used when the embroidery pattern is sewn. The partial patterns 51A to 51D illustrated in FIG. 2B represent stems and are sewn using brown sewing thread. The partial patterns 52A and 52B illustrated in FIG. 2C represent petals and are sewn using red sewing thread. The partial patterns 53A to 53F illustrated in FIG. 2D represent leaves and are sewn using green sewing thread. Hereinafter, the partial patterns 51A to 51D will be referred to as "partial patterns 51" unless otherwise specified. The partial patterns 52A and 52B will be referred to as "partial patterns 52" unless otherwise specified. The partial patterns 53A to 53F will be referred to as "partial patterns 53" unless otherwise specified. The partial patterns 51 to 53 will be collectively referred to as "plurality of partial patterns 50".

Figures 3A, 3B, 3C:
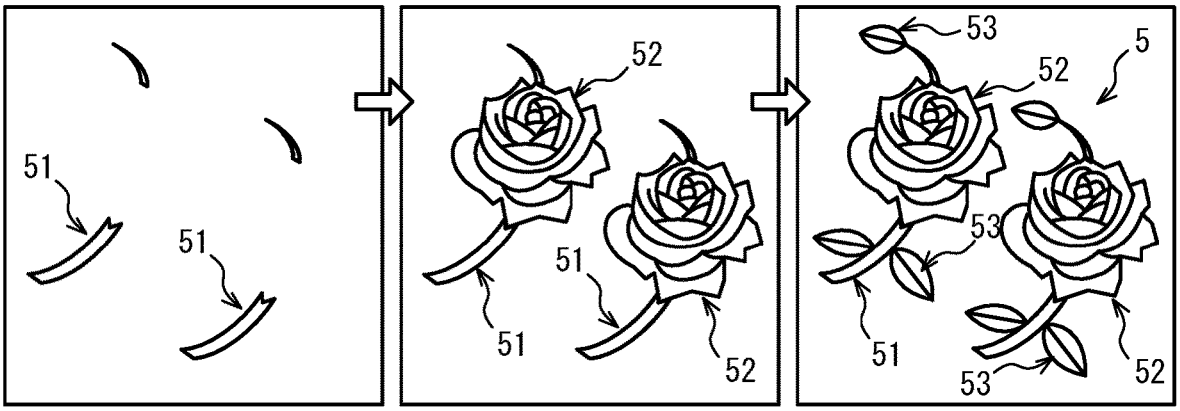
FIG. 3A to FIG. 3C are views of a process in which the partial patterns are sewn in order.

The embroidery data prescribes coordinate data (hereinafter, referred to as "needle drop coordinate data") indicating the position of the needle drop point, and the sewing order and thread color for each of the plurality of partial patterns 50. As illustrated in FIG. 3A to 3C, a case in which the partial patterns 51 (refer to FIG. 3A), 52 (refer to FIG. 3B), and 53 (refer to FIG. 3C) are sewn in order while the thread color of the sewing thread is changed in order from "brown to red to green" such that the embroidery pattern 5 is ultimately formed on the object 30 to be sewn, will be given as an example. FIG. 4 schematically shows the needle drop coordinate data, thread color, and sewing order prescribed by embroidery data D1 for performing such sewing. In the embroidery data D1, "brown" is set as the thread color and "1" is set as the sewing order for the needle drop coordinate data for sewing the partial patterns 51. "Red" is set as the thread color and "2" is set as the sewing order for the needle drop coordinate data for sewing the partial patterns 52. "Green" is set as the thread color and "3" is set as the sewing order for the needle drop coordinate data for sewing the partial patterns 53. The "coordinate data" in the drawings indicates the "needle drop coordinate data".

Outline of the Sewing Machine 3

Figures 5A, 5B:
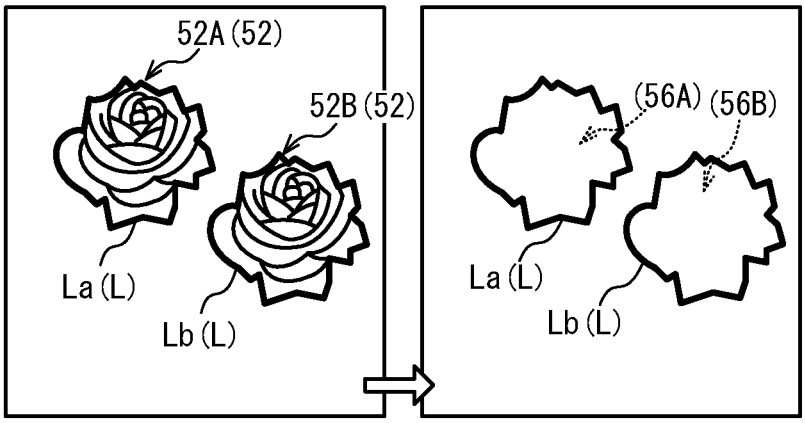
FIG. 5A and FIG. 5B are views of partial pattern outlines and pieces.

The sewing machine 3 has a function of replacing at least one of the plurality of partial patterns 50 included in the embroidery pattern 5 with cloth or the like different from the object 30 to be sewn, and sewing. For example, a case in which the partial patterns 52 in FIG. 2C are replaced with another cloth or the like and sewn will be described in detail. In this case, the sewing machine 3 generates processing data (refer to FIG. 5B) from the needle drop coordinate data of the partial patterns 52 illustrated in FIG. 5A. The processing data is data for the cutting device 4 to cut the object 40 to be cut following the shapes of the partial patterns 52A and 52B on the basis of outlines La and Lb (refer to FIG. 5A) of the outer shape of the partial patterns 52A and 52B, respectively. The processing data is coordinate data indicative of the outlines La and Lb of the outer shapes of the partial patterns 52A and 52B, respectively. Note that the processing data can also be used as data for performing sewing in the sewing machine 3. For example, the sewing machine 3 identifies needle drop positions on the basis of the processing data, and performs the sewing. The cutting device 4 can cut, from the object 40 to be cut, a piece 56A having the shape of the partial pattern 52A, and a piece 56B having the shape of the partial pattern 52B, by being driven on the basis of the processing data. Hereinafter, the outlines La and Lb will be collectively referred to as "outlines L" unless otherwise specified.

After generating the processing data, the sewing machine 3 adds the generated processing data to the original embroidery data D1 to create embroidery data D2 (refer to FIG. 6). FIG. 6 shows a specific example of the embroidery data D2.

An example of operations of the sewing machine 3 and the cutting device 4 on the basis of the embroidery data D2 illustrated in FIG. 6 will be described with reference to FIG. 7A to FIG. 7E.

The sewing machine 3 sends the embroidery data D2 (refer to FIG. 6) to the server device 2 in order to cause the cutting device 4 to cut the pieces 56A and 56B. The server device 2 receives the embroidery data D2 from the sewing machine 3 and stores the received embroidery data D2 in the storage portion 22. Also, the server device 2 sends the embroidery data D2 stored in the storage portion 22 to the cutting device 4 in response to a request from the cutting device 4. The cutting device 4 receives the embroidery data D2 sent from the server device 2. The cutting device 4 is driven on the basis of the processing data. On the basis of the processing data included in the embroidery data D2, the cutting device 4 generates the cutting data needed for cutting the object 40 to be cut. The cutting data prescribes control parameters for each of the conveyance mechanism, the first movement mechanism, and the second movement mechanism of the cutting portion 43 at the time of cutting the object 40 to be cut. The cutting device 4 drives the cutting portion 43 on the basis of the generated cutting data, and cuts the pieces 56A and 56B from the object 40 to be cut.

Figures 7A, 7B, 7C:
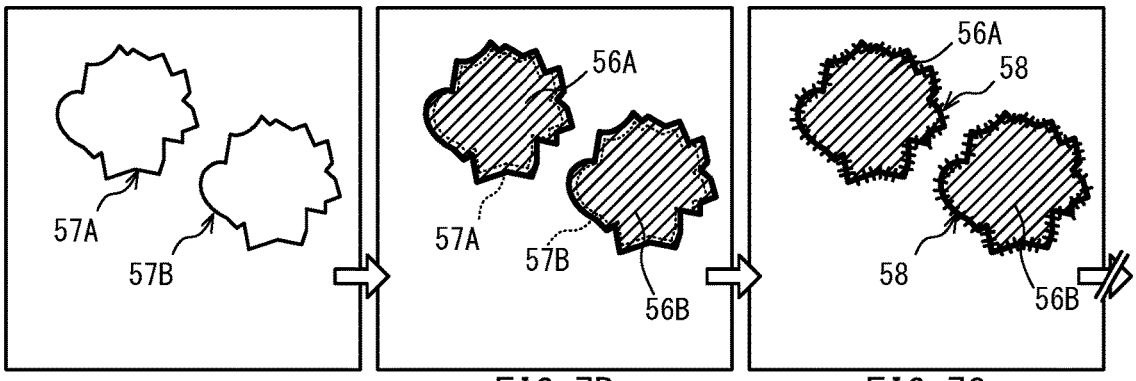
FIG. 7A to FIG. 7E are views of a sewing operation.

The sewing machine 3 starts sewing based on the various data in the embroidery data D2. First, the CPU 31 drives the sewing machine 3 on the basis of the processing data, of the embroidery data D2, and sews positioning markers 57A and 57B, which a user uses for positioning the pieces 56A and 56B with respect to the object 30 to be sewn, on the object 30 to be sewn, as illustrated in FIG. 7A. Next, the user, arranges the piece 56A cut by the cutting device 4 in the position indicated by the positioning marker 57A sewn onto the object 30 to be sewn, as illustrated in FIG. 7B. The user also arranges the piece 56B cut by the cutting device 4 in the position indicated by the positioning marker 57B sewn onto the object 30 to be sewn.

Next, the sewing machine 3 is driven on the basis of the processing data of the embroidery data D2, and sews stitches 58 for sewing the pieces 56A and 56B to the object 30 to be sewn, as illustrated in FIG. 7C. As a result, the pieces 56A and 56B are sewn onto the object 30 to be sewn.

Figures 7D, 7E:
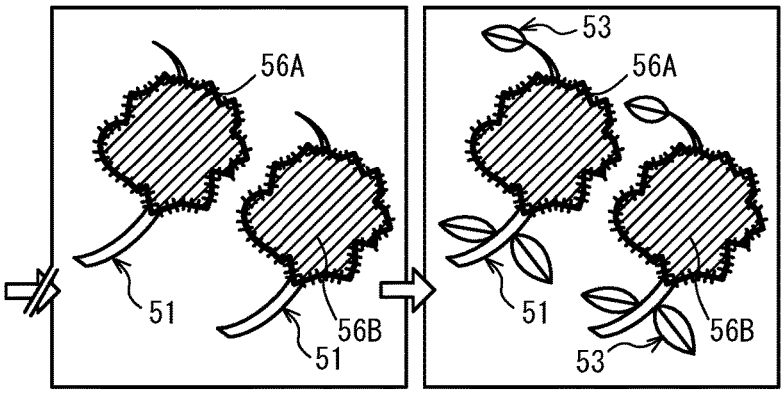

Next, the sewing machine 3 is driven on the basis of the needle drop coordinate data (refer to FIG. 6) of the partial patterns 51, of the embroidery data D2, and sews the partial patterns 51 on the object 30 to be sewn onto which the pieces 56A and 56B have been sewn, as illustrated in FIG. 7D. Next, the sewing machine 3 is driven on the basis of the needle drop coordinate data (refer to FIG. 6) of the partial patterns 53, of the embroidery data D2, and sews the partial patterns 53 onto the object 30 to be sewn onto which the pieces 56A and 56B and the partial patterns 51 have been sewn, as illustrated in FIG. 7E. Note that, although a detailed description is omitted here, in the course of the embroidery data D2 being created by adding the processing data to the embroidery data D1, driving on the basis of the needle drop coordinate data of the partial patterns 52, of the embroidery data D2, is prohibited. Thus, even when the sewing is performed on the basis of the embroidery data D2, the partial patterns 52 are not sewn onto the object 30 to be sewn.

Sewing Main Process

Figure 8:
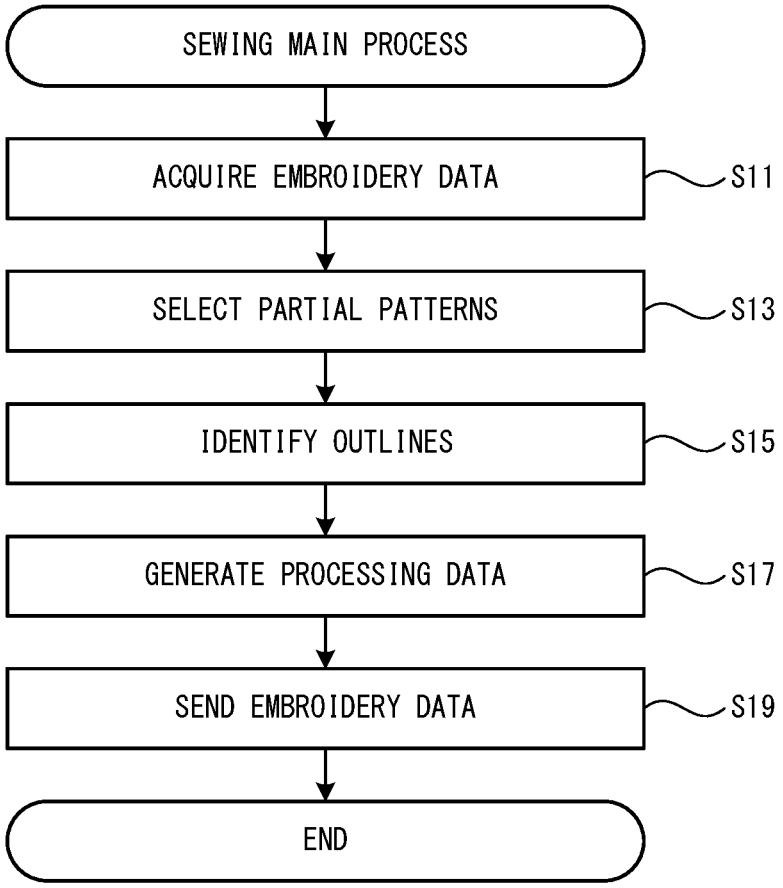
FIG. 8 is a flowchart of a sewing main process.

A sewing main process executed by the CPU 31 of the sewing machine 3 will be described with reference to FIG. 8. The sewing main process starts in response to the CPU 31 reading and executing the sewing program stored in the storage portion 32 when the user performs, via the input portion 35, an operation to specify an embroidery pattern and send the embroidery data to the cutting device 4. In the description below, it will be presumed that the embroidery pattern 5 illustrated in FIG. 2A has been specified by the user.

Figure 9:
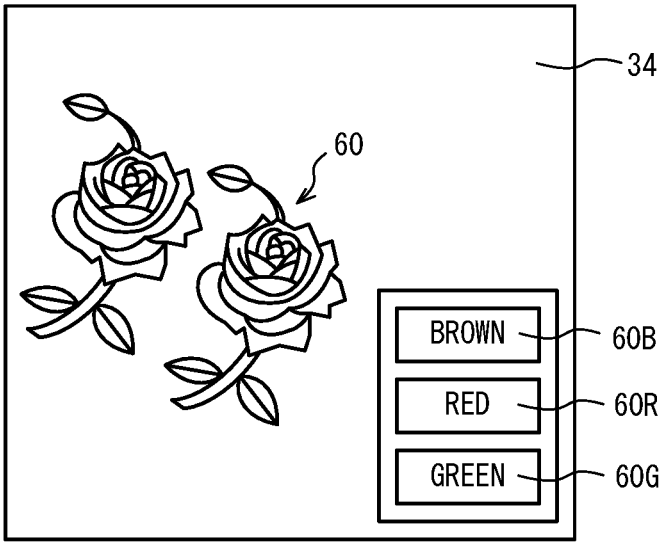
FIG. 9 is a view of a pattern image and selection buttons displayed on a display portion.

The CPU 31 reads and acquires the embroidery data D1 (refer to FIG. 4) for sewing the embroidery pattern 5 specified by the user, from among the embroidery data stored in the storage portion 32 (step S11). The CPU 31 displays, on the display portion 34, a pattern image 60 (refer to FIG. 9) showing the specified embroidery pattern 5, on the basis of the acquired embroidery data D1. Also, the CPU 31 identifies the thread color (brown, red, green) prescribed by the acquired embroidery data D1. The CPU 31 further displays, on the display portion 34, selection buttons 60B, 60R, and 60G (refer to FIG. 9) by which each of the identified thread colors can be selected. FIG. 9 shows the pattern image 60 and the selection buttons 60B, 60R, and 60G displayed on the display portion 34.

A case will be presumed in which the user has performed an operation to select the selection button 60R for selecting red as the thread color. As illustrated in FIG. 8, the CPU 31 receives the selection of red via the input portion 35. The CPU 31 identifies the needle drop coordinate data corresponding to red, which is the thread color that was received, and selects the corresponding partial patterns 52A and 52B (refer to FIG. 2C) on the basis of the embroidery data D1 acquired through the processing in step S11 (step S13).

The CPU 31 generates an image of the partial patterns 52 on the basis of the needle drop coordinate data of the partial patterns 52 in the embroidery data D1, and identifies the outlines L of the outer shapes of the partial patterns 52 (step S15). Note that the partial patterns 52A and 52B that have a common thread color of red are selected by the processing in step S13, so the CPU 31 identifies both the outline La (refer to FIG. 5B) of the partial pattern 52A and the outline Lb (refer to FIG. 5B) of the partial pattern 52B. The CPU 31 generates, on the basis of the outlines La and Lb, processing data for the cutting device 4 to cut out the object 40 to be cut following the shapes of the partial patterns 52A and 52B, respectively (step S17). The CPU 31 includes the generated processing data in the embroidery data D1 and generates the embroidery data D2. The CPU 31 sends the embroidery data D2 to the server device 2 via the network line 10 and the access point 11 (step S19). The CPU 31 ends the sewing main processing.

Server Main Process

Figure 10:
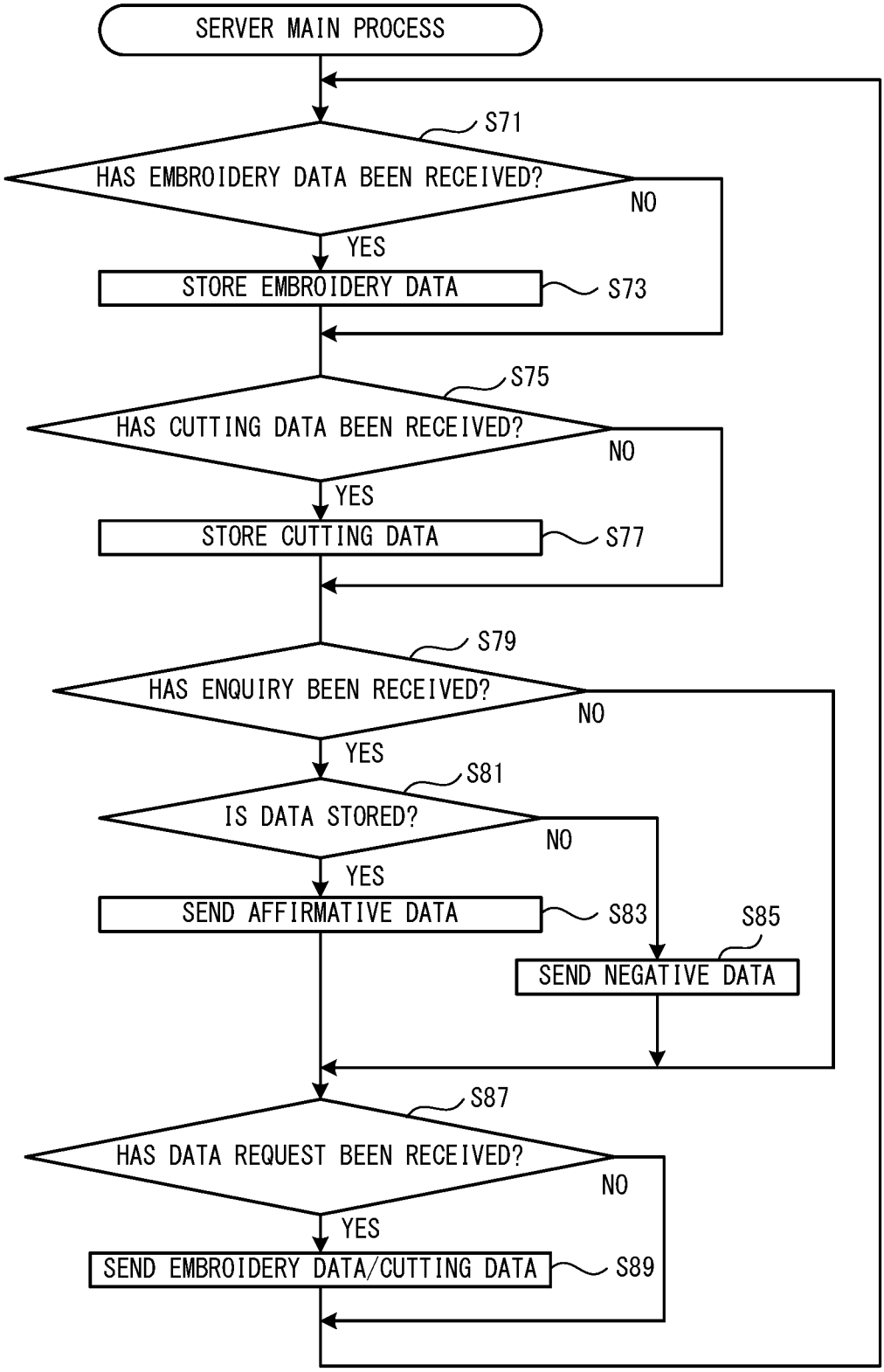
FIG. 10 is a flowchart of a server main process.

A server main process to be executed by the CPU 21 of the server device 2 will now be described with reference to FIG. 10. The server main process is started in response to the CPU 21 reading and executing the server program stored in the storage portion 22 when the power supply of the server device 2 is turned on.

The CPU 21 determines whether the embroidery data sent from the sewing machine 3 has been received via the network line 10 and the access point 11 (step S71). If the CPU 21 determines that the embroidery data has been received (yes at step S71), the CPU 21 stores the received embroidery data in the storage portion 22 (step S73). The CPU 21 then moves the processing on to step S75. If the CPU 21 determines that the embroidery data has not been received (no at step S71), the CPU 21 moves the processing on to step S75.

The CPU 21 determines whether the cutting data sent from the cutting device 4 has been received via the network line 10 and the access point 11 (step S75). Note that a detailed description will be omitted, but there may be cases in which the cutting device 4 sends the generated cutting data to the server device 2 via the network line 10 and the access point 11. If the CPU 21 determines that the cutting data has been received (yes at step S75), the CPU 21 stores the received cutting data in the storage portion 22 (step S77). The CPU 21 then moves the processing on to step S79. If the CPU 21 determines that the cutting data has not been received (no at step S75), the CPU 21 moves the processing on to step S79.

The CPU 21 determines whether a data enquiry sent from the cutting device 4 has been received (step S79). The data enquiry is data for enquiring whether the embroidery data or the cutting data are stored in the storage portion 22. Type data indicating a type of the embroidery data or the cutting data is included in the data enquiry. If it is determined that the data enquiry has been received (yes at step S79), the CPU 21 determines whether the embroidery data or the cutting data indicated by the type data included in the data enquiry is stored in the storage portion 22 (step S81). If it is determined that the embroidery data or the cutting data indicated by the type data is stored in the storage portion 22 (yes at step S81), the CPU 21 sends affirmative data indicating that the data is stored to the cutting device 4 (step S83). The CPU 21 moves the processing on to step S87. If it is determined that the embroidery data or the cutting data indicated by the type data is not stored in the storage portion 22 (no at step S81), the CPU 21 sends negative data indicating that the data is not stored to the cutting device 4 (step S85). The CPU 21 moves the processing on to step S87. If it is determined that the data enquiry has not been received (no at step S79), the CPU 21 moves the processing on to step S87.

The CPU 21 determines whether a data request sent from the cutting device 4 has been received (step S87). The data request is data for requesting the transmission of the embroidery data or the cutting data. The type data is included in the data request. When the data request has been received (yes at step S87), the CPU 21 identifies which of the embroidery data and the cutting data is indicated by the type data included in the data request. If it is identified that the type data indicates the embroidery data, the CPU 21 sends the embroidery data stored in the storage portion 22, to the cutting device 4 via the network line 10 and the access point 11 (step S89). If it is identified that the type data indicates the cutting data, the CPU 21 sends the cutting data stored in the storage portion 22, to the cutting device 4 via the network line 10 and the access point 11 (step S89). The CPU 21 returns the processing to step S71. If it is determined that the data request has not been received (no at step S87), the CPU 21 returns the processing to step S71.

Cutting Main Process

A cutting main process executed by the CPU 41 of the cutting device 4 will be described with reference to FIG. 11. The cutting main process starts in response to the CPU 41 reading and executing the cutting program stored in the storage portion 42, when an operation has been performed by the user, via the input portion 45, to select the embroidery data or the cutting data, as the type of data to be acquired from the server device 2.

The CPU 41 acquires the type of data selected by the operation performed via the input portion 45 (the embroidery data or the cutting data) (step S31). The CPU 41 sends, to the server device 2 via the network line 10 and the access point 11, the data enquiry including the type data indicating the acquired type (step S33). In response to the data enquiry, the server device 2 sends the affirmative data or the negative data to the cutting device 4 (refer to step S83 and step S85 in FIG. 10). When the CPU 41 has received the negative data sent by the server device 2, the CPU 41 determines that the type of data selected by the user is not stored in the storage portion 22 of the server device 2 (no at step S35). In this case, the CPU 41 ends the cutting main process. On the other hand, when the CPU 41 has received the affirmative data sent by the server device 2, the CPU 41 determines that the type of data selected by the user is stored in the storage portion 22 of the server device 2 (yes at step S35). In this case, the CPU 41 moves the processing on to step S37.

When the type of data selected by the user is the embroidery data (yes at step S37), the CPU 41 sends, to the server device 2 via the network line 10 and the access point 11, the data request including the type data indicating the embroidery data (step S39). The CPU 41 receives, via the network line 10 and the access point 11, the embroidery data sent from the server device 2 in response to the data request (step S43). Hereinafter, a case is assumed in which the embroidery data D2 illustrated in FIG. 6 is received.

Figure 12A:
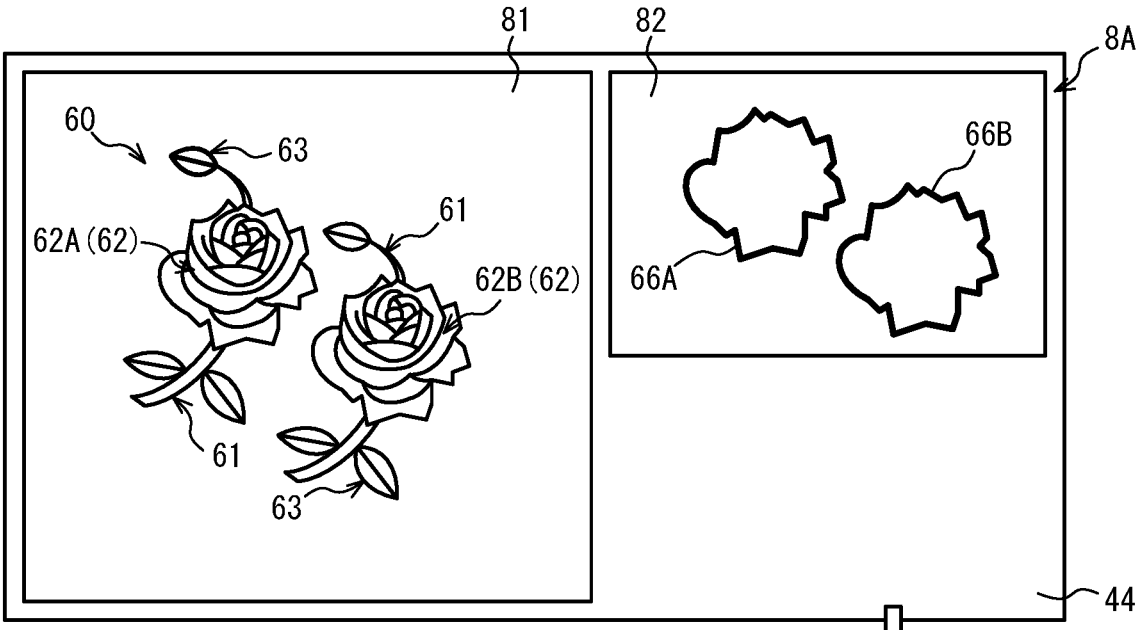
FIG. 12A and FIG. 12B are views of a preview image and an editing image displayed on the basis of the embroidery data.

The CPU 41 displays a preview image 8A illustrated in FIG. 12A on the display portion 44 (step S45). Windows 81 and 82 are included in the preview image 8A. The pattern image 60 showing the embroidery pattern 5 is displayed in the window 81. The pattern image 60 is formed from pattern images 61, 62, and 63 respectively showing the partial patterns 51, 52, and 53. The pattern images 61 to 63 are generated on the basis of the needle drop coordinate data of each of the partial patterns 51 to 53 included in the embroidery data D2.

Cutting lines 66A and 66B are displayed in the window 82. The cutting line 66A has the same shape as the outline La of the partial pattern 52A (refer to FIG. 5A). The cutting line 66B has the same shape as the outline Lb of the partial pattern 52B (refer to FIG. 5A). The cutting lines 66A and 66B are generated on the basis of the processing data included in the embroidery data D2.

Figure 11:
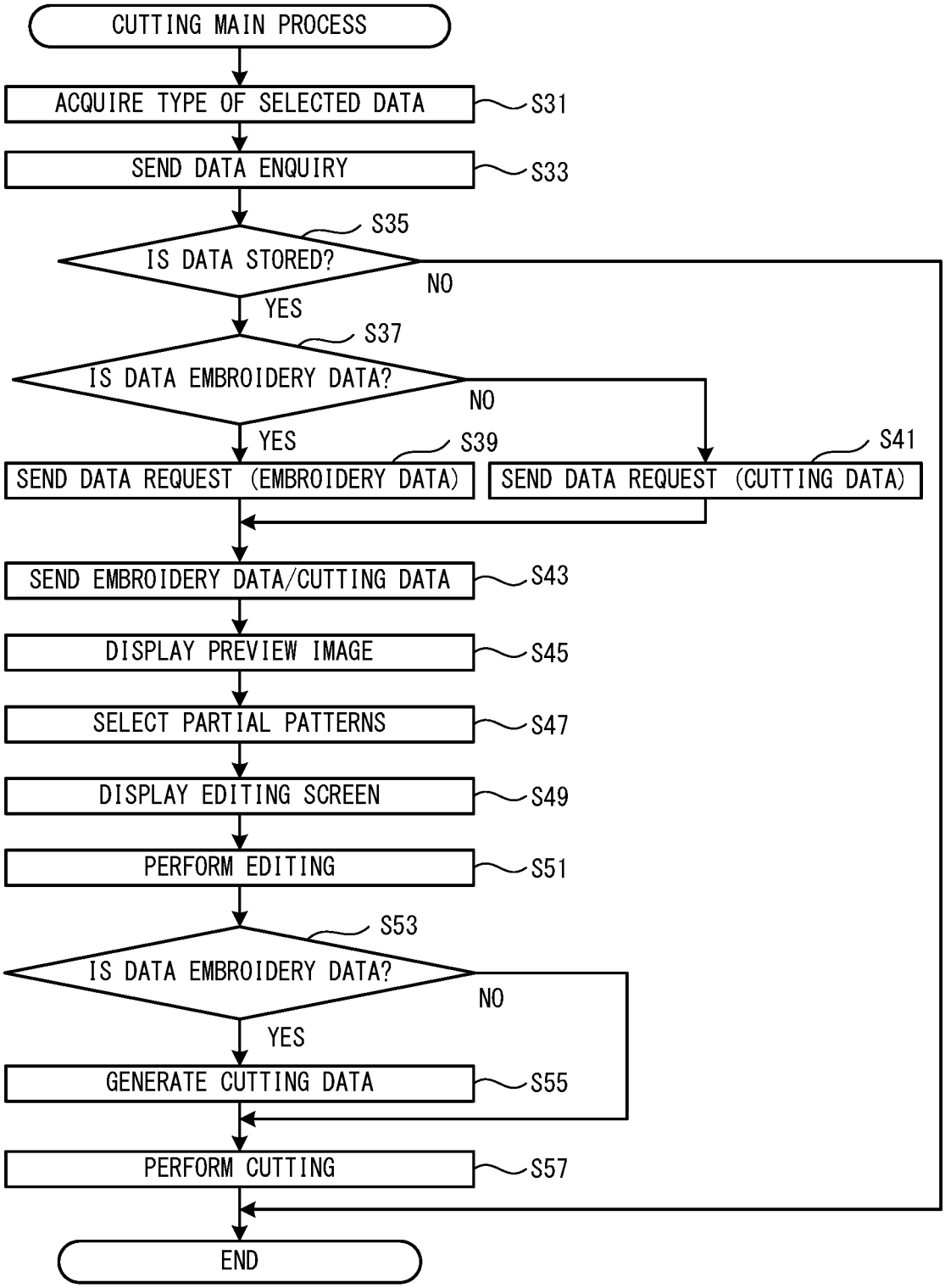
FIG. 11 is a flowchart of a cutting main process.

As illustrated in FIG. 11, after displaying the preview image 8A (refer to FIG. 12A) on the display portion 44, the CPU 41 accepts a selection operation of the partial pattern performed via the input portion 45. Here, the user can select, as a cutting target by the cutting device 4, one of the partial patterns 52A or 52B (refer to FIG. 2C) corresponding to the cutting lines 66A and 66B in the window 82. For example, when selecting the partial pattern 52A, the user performs an operation to touch the pattern image 62A corresponding to the partial pattern 52A, of the pattern images 62A and 62B in the window 81. In this case, the CPU 41 accepts the operation by the user, and selects the partial pattern 52A (step S47).

Figure 12B:
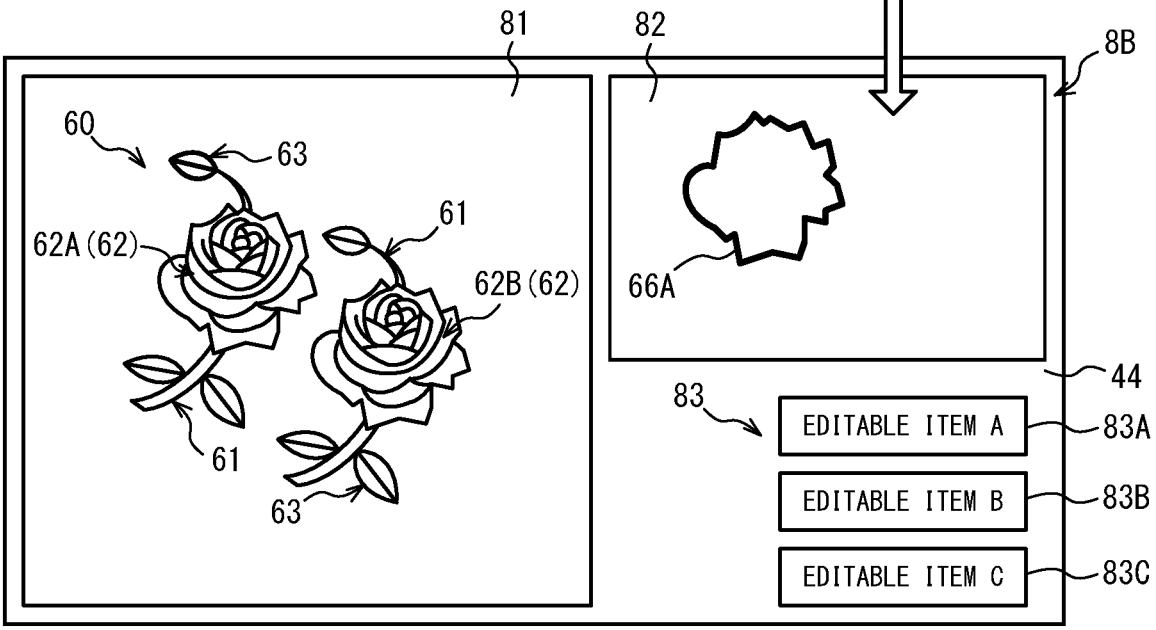

Next, the CPU 41 displays an editing screen 8B illustrated in FIG. 12B on the display portion 44 (step S49). The editing screen 8B differs from the preview image 8A (refer to FIG. 12A) in that only the cutting line 66A of the partial pattern 52A selected by the processing at step S47 (refer to FIG. 11) is displayed in the window 82, and menu buttons 83 are added and displayed. The menu buttons 83 include a plurality of editable items 83A to 83C for editing the cutting line 66A. Editing methods, such as smoothing of the cutting line, seam allowance setting, line addition, dot conversion, and the like, are allocated to the editable items 83A to 83C. When an operation on the menu buttons 83 via the input portion 45 is detected, the CPU 41 updates the processing data included in the embroidery data, in order to perform the corresponding editing operation on the cutting line 66A (step S51).

The CPU 41 determines whether the embroidery data has been received by the processing at step S43 (step S53). The CPU 41 determines that the embroidery data has been received (yes at step S53). On the basis of the processing data updated by the processing at step S51, of the embroidery data, the CPU 41 generates the cutting data necessary to cut the object 40 to be cut along the edited cutting line 66A (step S55). The CPU 41 controls each of the conveyance mechanism, the first movement mechanism, and the second movement mechanism on the basis of the generated cutting data, and cuts the object 40 to be cut (step S57). In this way, the piece 56A (refer to FIG. 7B to FIG. 7E) is cut from the object 40 to be cut. The CPU 41 ends the cutting main process.

On the other hand, when the type of data selected by the user is the cutting data (no at step S37), the CPU 41 sends, to the server device 2 via the network line 10 and the access point 11, the data request including the type data indicating the cutting data (step S41). The CPU 41 receives, via the network line 10 and the access point 11, the cutting data sent from the server device 2 in response to the data request (step S43). Hereinafter, the description will assume a case in which the cutting data for cutting the object 40 to be cut along the outlines La and Lb of the partial patterns 52A and 52B has been received.

Figures 13A, 13B:
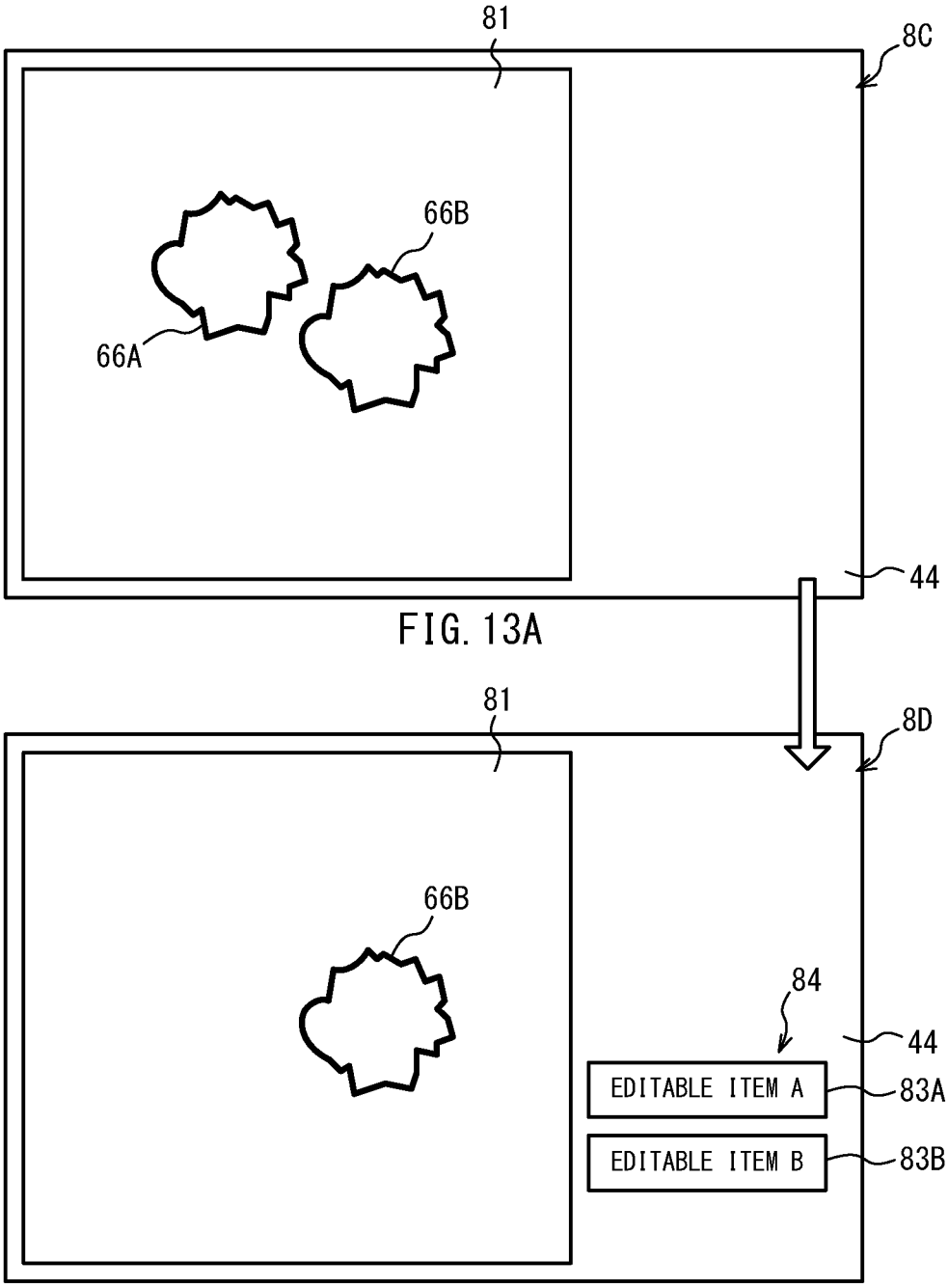
FIG. 13A and FIG. 13B are views of a preview image and an editing screen displayed on the basis of cutting data.

The CPU 41 displays a preview image 8C illustrated in FIG. 13A on the display portion 44 (step S45). The preview image 8C differs from the preview image 8A (refer to FIG. 12A) in that the window 82 is not included, and the cutting lines 66A and 66B having the same shape as the outlines La and Lb (refer to FIG. 5A) of the partial patterns 52A and 52B are displayed in the window 81. The cutting lines 66A and 66B are respectively generated on the basis of the cutting data.

As illustrated in FIG. 11, after displaying the preview image 8C (refer to FIG. 13A) on the display portion 44, the CPU 41 accepts a selection operation of the partial pattern performed via the input portion 45. Here, it is assumed that the user selects, the cutting line 66B corresponding to the partial pattern 52B (refer to FIG. 2C) in the window 81. In this case, the CPU 41 accepts the operation by the user, and selects the cutting line 66B (step S47).

Next, the CPU 41 displays an editing screen 8D illustrated in FIG. 12B on the display portion 44 (step S49). The editing screen 8D differs from the preview image 8C (refer to FIG. 13A) in that only the cutting line 66B selected by the processing at step S47 (refer to FIG. 11) is displayed in the window 81, and menu buttons 84 are added and displayed. The editable items 83A and 83B are included in the menu buttons 84. The editable items 83A and 83B of the menu buttons 84 are different from the editable items 83A to 83C of the menu buttons 83 of the editing screen 8B (refer to FIG. 12B) displayed when the embroidery data is received. The editable items 83C that are not possible with respect to the cutting data are removed from the menu buttons 84 of the editing screen 8D, and only the editable items 83A and 83B that are possible with respect to the cutting data are included. The smoothing of the cutting lines can be given as a specific example of the editing method of the editable items 83C that are not possible with respect to the cutting data.

When an operation on the menu buttons 84 via the input portion 45 is detected, the CPU 41 updates the cutting data, in order to perform the corresponding editing operation on the cutting line 66B (step S51). The CPU 41 determines that the embroidery data has not been received by the processing at step S43 (no at step S53). The CPU 41 moves the processing on to step S57. The CPU 41 controls each of the conveyance mechanism, the first movement mechanism, and the second movement mechanism on the basis of the updated cutting data, and cuts the object 40 to be cut (step S57). In this way, the piece 56B (refer to FIG. 7B to FIG. 7E) is cut from the object 40 to be cut. The CPU 41 ends the cutting main process.

Note that the pieces 56A and 56B cut by the cutting device 4 are sewn onto the object 30 to be sewn by the sewing machine 3. Furthermore, as a result of the partial patterns 51 and 53 being sewn onto the object 30 to be sewn, the embroidery pattern 5 is sewn in which the partial patterns 52 are replaced by the pieces 56A and 56B.

Operations and Effects of the Present Disclosure

The cutting device 4 receives, via the network line 10 and the access point 11, the embroidery data sent by the sewing machine 3 (step S43), and generates the cutting data on the basis of the received embroidery data (step S55). The cutting device 4 acquires the embroidery data from the sewing machine 3 by cooperating with the sewing machine 3, and can generate the cutting data necessary when cutting the object 40 to be cut.

The server device 2 receives the embroidery data from the sewing machine 3, and stores the received embroidery data. The cutting device 4 receives the embroidery data from the server device 2. In other words, the cutting device 4 receives the embroidery data sent from the sewing machine 3 via the server device 2. Thus, the cutting device 4 can receive the embroidery data from the server device 2 at a desired timing, without the need to perform direct communication with the sewing machine 3.

The sewing machine 3 selects the partial patterns 52A and 52B, of the partial patterns 51 to 53, in accordance with the operation by the user (step S13). The sewing machine 3 generates the processing data on the basis of the needle drop coordinate data of the selected partial patterns 52A and 52B. The cutting device 4 generates the cutting data for cutting along the outlines La and Lb of the partial patterns 52A and 52B, on the basis of the processing data included in the received embroidery data (step S55). In this case, of the plurality of partial patterns 50 configuring the embroidery pattern 5, the cutting device 4 can generate the cutting data for cutting along the outlines of the partial patterns 52A and 52B selected by the user, via the sewing machine 3. Thus, the cutting device 4 can generate the cutting data for cutting part of the embroidery pattern 5, on the basis of the embroidery data received from the sewing machine 3.

When, of the partial patterns 52A and 52B for which the outlines can be identified on the basis of the processing data included in the received embroidery data, the partial pattern 52A has been selected by the user (step S47), the cutting device 4 generates the cutting data for cutting along the outline La of the selected partial pattern 52A (step S47). In this case, the user can select the desired partial pattern 52A, of the partial patterns 52A and 52B, and can cause the cutting device 4 to cut the corresponding piece 56A.

The cutting device 4 displays the pattern image 60 and the cutting lines 66A and 66B on the display portion 44, using the preview image 8A (step S45). Thus, the user of the cutting device 4 can verify the embroidery pattern 5 shown by the pattern image 60, and the outer shapes of the pieces 56A and 56B shown by the cutting lines 66A and 66B.

When one of the thread colors of the sewing thread to sew the embroidery pattern 5 has been selected by the user, the sewing machine 3 selects the partial patterns 52 corresponding to the selected thread color (red, for example) (step S13). In this way, the sewing machine 3 can select the partial patterns 52 from the plurality of partial patterns 50 into which the embroidery pattern 5 is divided by each of the colors of the sewing threads, and can generate the processing data on the basis of the shape of the partial patterns 52.

The server device 2 stores the cutting data in the storage portion 22 in addition to the embroidery data. The server device 2 receives the data request sent from the cutting device 4 (yes at step S87). The server device 2 sends, to the cutting device 4, the embroidery data or the cutting data indicated by the type data included in the data request (step S89). Thus, the cutting device 4 can acquire, from the server device 2, the desired type of data, of the embroidery data and the cutting data.

In the cutting device 4, the items with which each of the embroidery data and the cutting data can be edited are sometimes mutually different. Here, the editable items of the menu buttons 83 and 84 displayed on the editing screens 8B and 8D are different between when the cutting device 4 receives the embroidery data and when the cutting device 4 receives the cutting data. Thus, the cutting device 4 can display, on the display portion 44, the different editable items for each of the data, that are appropriate for editing the processing data in the embroidery data or for editing the cutting data.

Modified Examples

The present disclosure is not limited to the foregoing embodiment; various modifications are possible. The server device 2 receives the embroidery data from the sewing machine 3, stores the received embroidery data in the storage portion 22, and sends the embroidery data to the cutting device 4 in accordance with the request. The server device 2 may receive, via the network line 10 and the access point 11, the embroidery data sent from an embroidery data creation device (PC, tablet terminal, smartphone, etc.) not shown in the drawings. Alternatively, the cutting device 4 may directly receive, via the network line 10 and the access point 11, the embroidery data sent from the embroidery data creation device, without passing through the server device 2.

The sewing machine 3 sends the embroidery data to the server device 2, and the cutting device 4 receives the embroidery data from the server device 2. For example, when a local area network (LAN) is formed by the sewing machine 3, the cutting device 4 and the access point 11, the sewing machine 3 may directly send the embroidery data to the cutting device 4 via the access point 11. The sewing machine 3 and the cutting device 4 may be capable of direct communication without using the access point 11, using various known wireless communication methods. In this case, the sewing machine 3 may directly send the embroidery data to the cutting device 4 via the wireless communication.

The processing data is the coordinate data showing the outlines La and Lb of the outer shapes of each of the partial patterns 52A and 52B selected by the user of the sewing machine 3. Thus, the cutting device 4 can identify that the partial patterns 52A and 52B have been selected by the user of the sewing machine 3, on the basis of the processing data. Information may be further added, to the processing data, for directly identifying the partial patterns 52A and 52B corresponding to the outlines La and Lb shown by the coordinate data, in other words, information directly showing that the partial patterns 52A and 52B have been selected by the user.

The sewing machine 3 may send, to the server device 2, the embroidery data that does not include the processing data. The cutting device 4 may receive, from the server device 2, the embroidery data that does not include the processing data. In this case, as information showing the partial pattern that has been selected, the sewing machine 3 may add, to the embroidery data, information showing the thread color for sewing the partial pattern selected by the processing at step S13 (hereinafter referred to as the "selected partial pattern"). Note that, the thread color for sewing the selected partial pattern may be identified by the thread color set for the needle drop coordinate data for sewing the selected partial pattern, of the embroidery data. Further, as selection information, the sewing machine 3 may add, to the embroidery data, information directly showing the selected partial pattern selected by the user. The cutting device 4 may display the preview image 8A and the editing screen 8B on the display portion 44, on the basis of the needle drop coordinate data of each of the partial patterns 51 to 53 included in the embroidery data. The cutting device 4 may identify the outlines of the partial patterns 51 to 53 and generate the cutting data, on the basis of the needle drop coordinate data of the partial patterns 51 to 53 included in the embroidery data. Furthermore, when the selection information is added to the embroidery data, the cutting device 4 may identify the selected partial pattern, from among the partial patterns 51 to 53, on the basis of the selection information, and may identify the outline of the identified selected partial pattern and generate the cutting data.

When the cutting device 4 generates the cutting lines 66A and 66B corresponding to the partial patterns 52A and 52B, the cutting device 4 may generate the cutting data for cutting both the cutting lines 66A and 66B at the same time. In this case, the cutting device 4 need not necessarily perform the processing (refer to step S45 and step S47) that causes the user to select one of the partial pattern 52A or 52B corresponding to the cutting lines 66A and 66B.

The sewing machine 3 may accept an operation to directly select a section of the embroidery pattern 5 displayed on the display portion 34. The sewing machine 3 may select the partial pattern including the accepted section.

The server device 2 may send the embroidery data or the cutting data to the cutting device 4, regardless of whether or not the data request has been received from the cutting device 4. The cutting device 4 may determine the type of the data received from the server device 2 (the embroidery data/the cutting data), and may automatically switch between the preview images 8A and 8C and the editing screens 8B and 8D in accordance with a determination result.

The same editable items 83A to 83C may be included in the menu buttons 83 and 84 of the editing screens 8B and 8D. In this case, for example, the operation of the editable items 83C by the user may be prohibited by displaying the editable items 83C included in the menu buttons 84 of the editing screen 8D in a see-through manner or the like.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cutting system including a sewing machine and a cutting device, the sewing machine comprising:

a sewing portion configured to sew an embroidery pattern on an object to be sewn, based on embroidery data for sewing the embroidery pattern, a sewing communication portion configured to perform communication via a network line, a sewing processor, and a sewing memory configured to store the embroidery data, and to store computer-readable instructions that, when executed by the sewing processor, instruct the sewing processor to perform processes comprising:

an acquisition process to acquire the embroidery data stored in the sewing memory; and a sewing send process to send, via the network line, using the sewing communication portion, the embroidery data acquired by the acquisition process, and the cutting device comprising:

a cutting portion configured to cut an object to be cut, based on cutting data, a cutter communication portion configured to perform communication via the network line, a cutter processor, and a cutter memory configured to store computer-readable instructions, that when executed by the cutter processor, instruct the cutter processor to perform processes comprising:

a cutter reception process to receive, via the network line, using the cutter communication portion, the embroidery data sent by the sewing machine;

a generation process to generate the cutting data, based on the embroidery data received by the cutter reception process; and a cutting process to drive the cutting portion based on the cutting data generated by the generation process, and cut the object to be cut.

2. The cutting system according to claim 1, further comprising:

a server, wherein the sewing send process includes sending the embroidery data to the server, the server includes a server communication portion configured to perform communication via the network line, a server processor, and a server memory configured to store computer-readable instructions that, when executed by the server processor, instruct the server processor to perform processes comprising:

a server first reception process to receive, via the network line, using the server communication portion, the embroidery data sent by the sewing machine, a server storage process to store, in the server memory, the embroidery data received by the server first reception process, and a server send process to send, using the server communication portion, the embroidery data stored in the server memory to the cutting device via the network line, and the cutter reception process includes receiving the embroidery data sent from the server.

3. The cutting system according to claim 2, wherein the embroidery data and the cutting data are stored in the server memory, the computer-readable instructions stored in the cutter memory further instruct the cutter processor to perform processes comprising:

a cutter send process to send, to the server via the network line, using the cutter communication portion, a data request including type data showing the embroidery data or the cutting data, the computer-readable instructions stored in the server memory further instruct the server processor to perform processes comprising:

a server second reception process to receive the data request sent from the cutting device, the server send process includes sending the embroidery data when the type data included in the data request received by the server second reception process shows the embroidery data, and sending the cutting data when the type data included in the data request received by the server second reception process shows the cutting data, and the cutter reception process includes receiving the embroidery data or the cutting data sent from the server.

4. The cutting system according to claim 3, wherein the cutting device further includes a display the computer-readable instructions stored in the cutter memory further instruct the cutter processor to perform processes comprising:

a display process to display, based on the embroidery data or the cutting data received by the cutter reception process, a cutting line and an editable item for editing the cutting line, on the display, and the display process includes causing the editable item displayed on the display to be different between when the embroidery data is received by the cutter reception process and when the cutting data is received by the cutter reception process.

5. The cutting system according to claim 1, wherein the acquisition process includes acquiring the embroidery data of the embroidery pattern formed from a plurality of partial patterns, the computer-readable instructions stored in the sewing memory further instruct the sewing processor to perform processes comprising:

a sewing selection process to select, as a selected partial pattern, at least one partial pattern from among the plurality of partial patterns acquired by the acquisition process, the sewing send process includes sending the embroidery data including selection information showing the selected partial pattern selected by the sewing selection process, from among the plurality of partial patterns, and the generation process includes generating, based on the selection information included in the embroidery data, the cutting data for performing cutting following an outline of the selected partial pattern.

6. The cutting system according to claim 5, wherein the sewing selection process includes selecting two or more partial patterns, as the selected partial patterns, the computer-readable instructions stored in the cutter memory further instruct the cutter processor to perform processes comprising:

a cutter selection process to select a target partial pattern, which is the partial pattern to be a cutting target, from the two or more partial patterns, which are the selected partial patterns shown by the selection information included in the embroidery data received by the cutter reception process, and the generation process includes generating the cutting data for performing cutting following an outline of the target partial pattern selected by the cutter selection process.

7. The cutting system according to claim 5, wherein the cutting device further includes a display, and the computer-readable instructions stored in the cutter memory further instruct the cutter processor to perform processes comprising:

a display process to display, on the display, the embroidery pattern, and a cutting line following the outline of the selected partial pattern, based on the embroidery data and the selection information received by the cutter reception process.

8. The cutting system according to claim 5, wherein the acquisition process includes acquiring the embroidery data of the embroidery pattern formed from the plurality of partial patterns in which the embroidery pattern is divided by thread color which is a color of thread used to sew the embroidery pattern, and the sewing selection process includes selecting, when a selection of the thread color is received, a partial pattern corresponding to the received thread color.

* * * * *